US007998005B2

(12) United States Patent
Geisendorfer

(10) Patent No.: US 7,998,005 B2
(45) Date of Patent: Aug. 16, 2011

(54) GAME BALL

(75) Inventor: Glenn Geisendorfer, Atlanta, GA (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 12/861,369

(22) Filed: Aug. 23, 2010

(65) Prior Publication Data

US 2010/0317471 A1 Dec. 16, 2010

Related U.S. Application Data

(63) Continuation of application No. 11/949,474, filed on Dec. 3, 2007, now Pat. No. 7,828,681.

(60) Provisional application No. 60/873,622, filed on Dec. 6, 2006.

(51) Int. Cl.
*A63B 43/02* (2006.01)

(52) U.S. Cl. ..... 473/569; 473/593; 473/597; 473/599; 473/604; 473/610

(58) Field of Classification Search ..... 473/593–599, 473/603–612; D21/707, 713
See application file for complete search history.

(56) References Cited

U.S. PATENT DOCUMENTS

| | | | | |
|---|---|---|---|---|
| 2,859,040 | A | 4/1958 | Gow et al. | |
| 2,931,653 | A | 5/1960 | Gow et al. | |
| 3,508,750 | A | 4/1970 | Henderson | |
| 4,991,842 | A | 2/1991 | Finley | |
| 5,354,053 | A | 10/1994 | Ratner et al. | |
| 5,681,233 | A | 10/1997 | Guenther et al. | |
| 6,123,633 | A | 9/2000 | Guenther et al. | |
| 6,283,881 | B1 | 9/2001 | Feeney | |
| 7,037,224 | B1 | 5/2006 | Page et al. | |
| 7,585,236 | B2 | 9/2009 | Krysiak | |
| 7,828,681 | B2 * | 11/2010 | Geisendorfer | 473/596 |
| 2003/0181266 | A1 | 9/2003 | Sowders | |
| 2007/0010360 | A1 | 1/2007 | Chang | |
| 2007/0254754 | A1 | 11/2007 | Lorhpipat et al. | |

OTHER PUBLICATIONS

International Search Report in corresponding PCT application, International Application No. PCT/US2007/086601, mailed Jun. 20, 2008.

International Preliminary Report on Patentability in corresponding PCT Application, International Application No. PCT/US2007/086601, mailed Jun. 18, 2009.

* cited by examiner

*Primary Examiner* — Gene Kim
*Assistant Examiner* — Joseph B Baldori
(74) *Attorney, Agent, or Firm* — Banner & Witcoff, Ltd.

(57) ABSTRACT

Ball structures, such as basketballs, are formed to include regions with different and distinct tactile characteristics or "feel." Such ball structures may include a cover member divided into plural panels that are separated by channels. The exterior surface of one or more of these panels may include regions having different textures. One region, which extends over a central portion of the panel, includes raised elements, such as raised ribs or other structures, that may extend at least 0.5 mm outward from a base surface of the cover member.

26 Claims, 7 Drawing Sheets

GAME BALL

RELATED APPLICATION DATA

This application is a continuation of U.S. application Ser. No. 11/949,474, filed on Dec. 3, 2007, which claims priority benefits based on U.S. Provisional Application Ser. No. 60/873,622 filed Dec. 6, 2006, both entitled "Game Ball" and naming Glenn Geisendorfer as the inventor. Both of these above referenced applications are incorporated herein by reference in their entirety.

FIELD OF THE INVENTION

The present invention relates to a game ball having improved tactile feel. Various examples of the invention may be particularly related to basketball structures having a plurality of ribs and/or other surface texture modifying elements arranged about their circumference.

BACKGROUND OF THE INVENTION

Many sports require a player to manipulate a ball with his or her hands. With the sport of basketball in particular, each player will typically hold, throw, and dribble the basketball frequently during the course of the game. In addition to requiring a player to manipulate the ball in a variety of different ways, basketball also requires that a player manipulate the ball using a variety of nuanced techniques. For example, in many sports, the game ball may be gripped by the entirety of a player's hand (e.g., baseball or softball), cradled securely in the player's arms (e.g., football or rugby), or slapped with an open hand or fist (e.g., handball or volleyball). In addition to each of these techniques, however, basketball typically requires that a player use his or her fingertips to manipulate and control the basketball. More particularly, a user will use his or her fingertips to dribble the ball or to precisely control the trajectory of the ball when throwing it to another player, e.g., using a "bounce pass."

Perhaps most importantly, however, a player will use his or her fingertips to precisely control the rotation and trajectory of the basketball when throwing or "shooting" the ball toward the hoop of a basketball goal in an effort to score. The rotation of a ball can generally be segregated into two components: speed of rotation and alignment of the ball during rotation. The speed of rotation relates to how fast the ball is revolving about an axis, while alignment relates to the degree to which the angle of that axis remains constant relative to the direction of the flight of the ball toward the target. To some extent, these components are related, for example, as a faster rotational speed helps to maintain a ball's alignment.

As a result of these features, contact feel or "touch" that a basketball provides to a player, and particularly to a player's fingertips, is an important characteristic. If the surface of a basketball is too smooth, a player's fingertips may slip when dribbling, passing or shooting the ball. On the other hand, if the basketball has a surface that is too sticky or "grippy," a player may find it difficult to separate his or her fingertips from the ball with a sufficient degree of precision to provide the ball with the desired direction of spin, rotational speed and trajectory. Improvements to the "touch" or "feel" of ball structures would be a welcome advance in the art.

SUMMARY

Various example structures according to this invention advantageously relate to a game ball, such as a basketball, having an improved tactile feel. With some implementations of the invention, the surface of the game ball will have a plurality of ribs or other surface texture modifying elements that provide an improved tactile feel for a player. The ribs or other elements may, for example, extend around the entire circumference of the game ball. Alternately, the ribs or other elements may be provided only at discrete areas around the circumference of the game ball. With at least some implementations of the invention, the ribs or other elements will provide a distinct appearance that is different from other surfaces of the ball. By providing the ribs or other surface texture modifying elements at only discrete areas around the circumference of the game ball, a player may use these areas to visually ascertain the rotational speed of the game ball during a throw or shot.

According to various examples of the invention, the ribs or other surface texture modifying elements may extend or align along a longitudinal axis of the game ball. This implementation may be particularly beneficial for a basketball, as many experts recommend that players shoot a basketball so that the basketball rotates about its longitudinal axis. Extending the ribs or other elements along the longitudinal axis of a basketball will provide a player with the maximum tactile contact when the player positions the basketball to be shot so that it rotates about its longitudinal axis.

Various advantages and features of novelty that characterize the invention are pointed out with particularity in the claims. For a better understanding of the invention, however, reference should be made to the drawings and to the accompanying descriptive matter.

DETAILED DESCRIPTION OF THE INVENTION

Figure 1A:
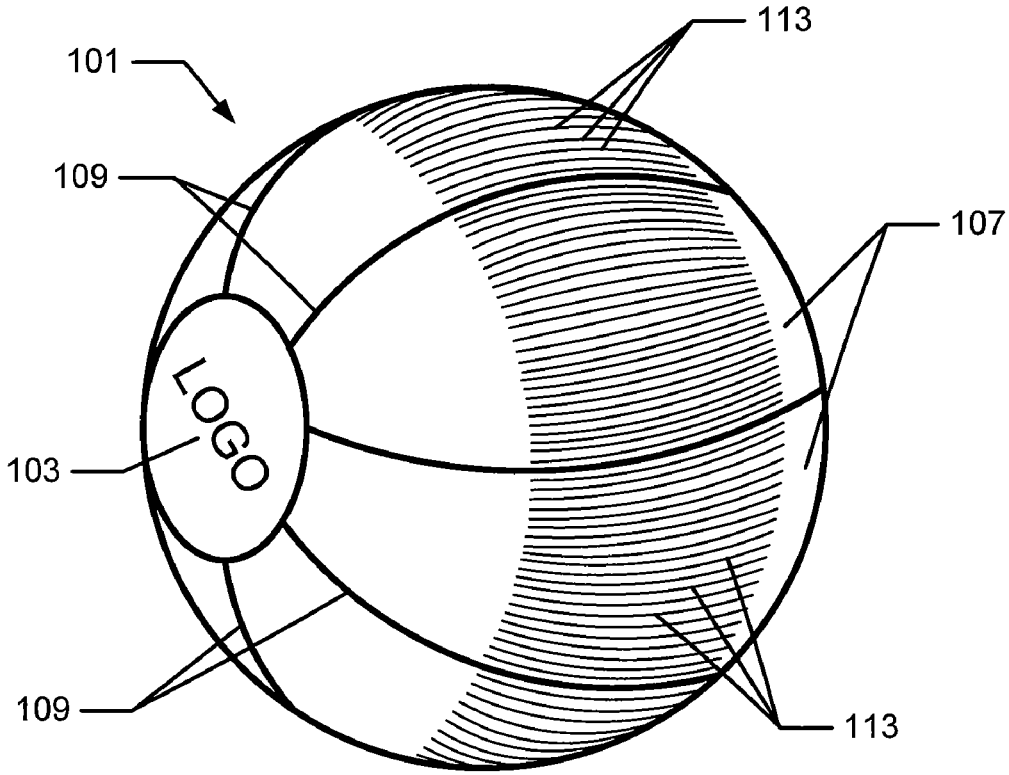
FIG. 1A is a perspective view an example basketball structure according to the invention.

A. General Description of Ball Structures According to Examples of this Invention Aspects of this invention relate to game ball structures, such as basketball structures, that include regions with distinctly different tactile characteristics or "feel." Game ball structures in accordance with at least some examples of this invention may include a ball structure having a cover member that defines or covers a gas-tight chamber, wherein the ball structure defines a first pole and an opposite second pole. The cover member in at least some example structures according to this invention may include an exterior surface divided into a plurality of panels that are separated from one another by one or more channels, and at least some of these panels may extend along a periphery or circumference of the ball structure from an area adjacent the first pole to an area adjacent the second pole. An exterior surface of one or more of these panels may be structured so as to include a first region having a first surface texture thereon and a second region having a second surface texture thereon that differs from the first surface texture. This first region may be arranged to extend at least over a central portion of the panel located between the first and second poles, while the second region may be arranged outside of this central portion of the panel and may have the structure and texture of a conventional ball surface (e.g., a "pebbled" texture of a conventional basketball surface). The exterior surface of the first region may includes plural raised elements, such as raised ribs, hemispheres, or other structures, that optionally extend at least 0.5 mm outward from a base surface of the cover member, so as to provide the first surface texture.

Additional aspects of this invention relate to cover members for a ball, such as a basketball, that include the various regions with different surface textures as described above. Such cover members may be fit over a gas-tight bladder or other internal structure of a ball, e.g., for holding air or other fluid, or the cover member itself may define at least a portion of a gas-tight chamber for the ball. A series of panels for a ball structure may con-joined together, e.g., on the ball structure itself and/or as a flat "blank" member that may be arranged and/or fixed together to fit around an internal structure of the ball.

If desired, the region(s) of the ball having the differently "textured surface" from that of a conventional ball may be centrally located on the ball, e.g., on the various panels between two opposing poles of the ball. The textured surfaces may be aligned on the various panels, and optionally colored somewhat differently, so as to provide a visual indicator of the ball's rotation. If desired, the differently textured surface(s) may be surrounded by a region or regions having conventional ball surface texture characteristics.

Additional aspects of this invention relate to features at and near the channels between adjacent panels. If desired, in ball structures in accordance with at least some examples of this invention, the major surface of this channel may be contoured, e.g., shaped so as to curve inwardly and away from a direction in which the ribs or other texture creating projections extend. Additionally (or alternatively), if desired, one or more of the ribs (or other texture creating projections) located immediately adjacent the channels may be sized, shaped, and/or otherwise arranged so as to slope toward the base surface (or major exterior surface) of the channel (to thereby make the transition into the channel more smooth and/or to thereby make the channel feel somewhat wider).

In light of this general description of aspects and features of this invention, a more detailed description of specific examples of ball structures in accordance with examples of this invention follows.

Figure 1B:
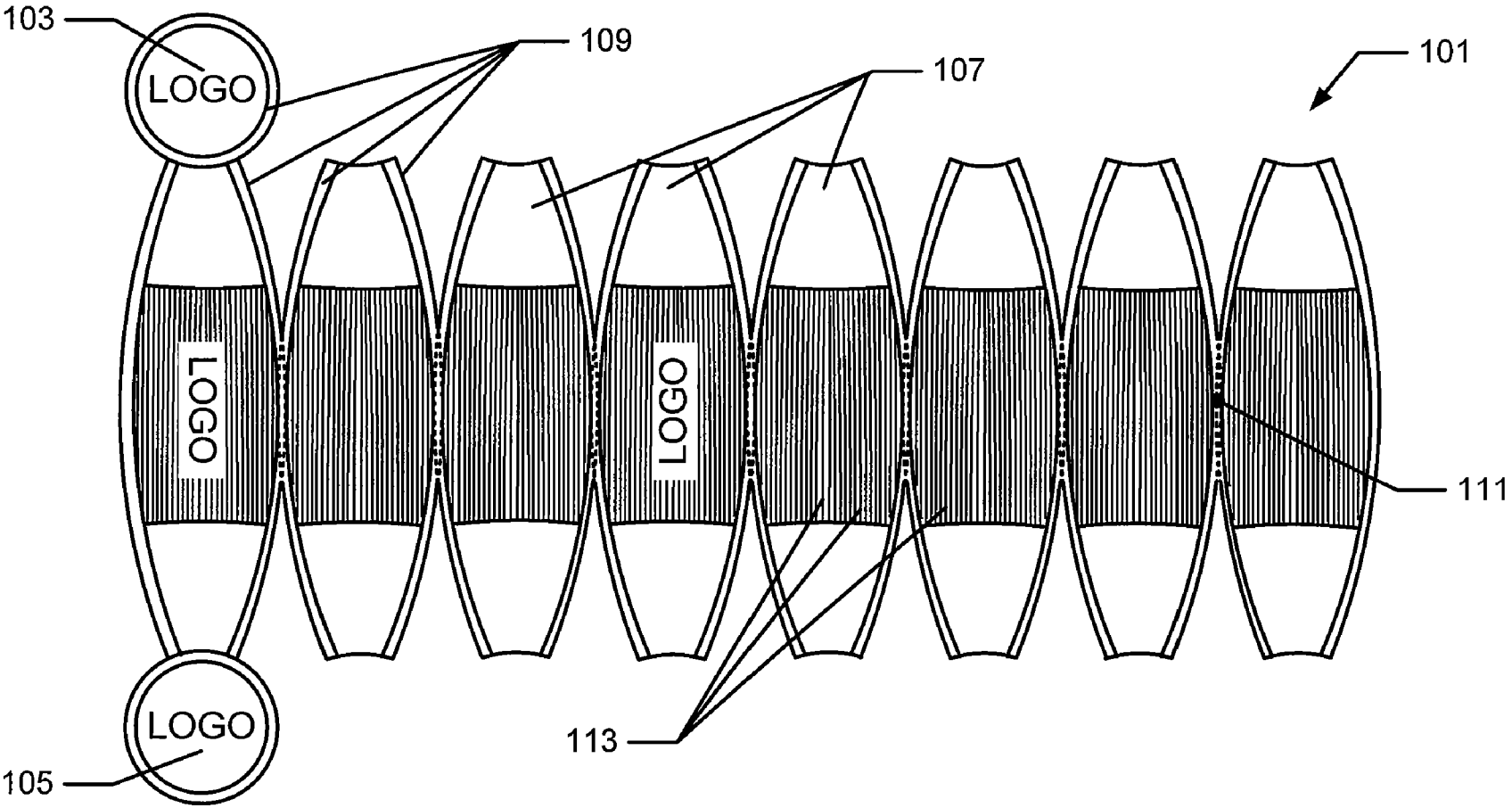
FIG. 1B is a flattened view of an exterior cover member of an example basketball of the type illustrated in FIG. 1A.

B. Detailed Description of Specific Examples of Ball Structures According to this Invention FIGS. 1A and 1B illustrate a basketball 101 according to various implementations of the invention. As illustrated in these figures, the basketball 101 has a first pole 103 and a second pole 105. A series of connected panels 107 running longitudinally between the first pole 103 and the second pole 105 forms the body and exterior cover member of the basketball 101. In particular, as shown in FIG. 1A, the basketball 101 of this example structure is made up of eight panels 107, but various embodiments of the invention may employ more panels or fewer panels. As also illustrated in this figure, with each pair of adjacent panels 107, the panels 107 are separated by a seam or channel 109. With the illustrated example, the poles 103 and 105 also are separated from the panels 107 by a channel 109. The basketball 101 further may include an internal bladder and a valve 111 for inflating the ball to a desired pressure.

The basketball 101 may be formed using any desired construction, such as any conventional basketball construction. For example, with some implementations of the invention, the basketball 101 may have an inner portion and an outer covering. The inner portion may include, e.g., a bladder and a carcass. With various examples of the invention, the bladder may be formed of butyl rubber, while the carcass may be formed of threads of nylon, polyester or other suitable material wound around the bladder. The outer covering may be formed of any desired natural or synthetic rubber composition or material, synthetic or natural leather, polymeric materials, or other desired materials. With some implementations of the invention, the outer covering may be formed of laminated rubber. The rubber may be natural or synthetic, and the rubber may be laminated with any desired material, such as polyurethane. Still further, the basketball 101 may be formed without an inner portion, i.e., such that the outer covering serves also as the airtight bladder for the ball. Various techniques and materials for constructing basketballs (and other game balls) are well known in the art, and thus will not be discussed here in more detail.

With various examples of the invention, the poles 103 and 105, panels 107, and channels 109 may be cosmetic. For example, the poles 103 and 105, panels 107, and channels 109 may be defined by artificially-created contours formed in the surface of the basketball's outer covering. Alternately, the poles 103 and 105 and panels 107 may be cosmetic (e.g., defined by artificially-created contours formed in the surface of the basketball's outer covering). The channels 109 may then also include material laminated, painted, or otherwise applied to corresponding contours formed in the surface of the basketball's outer covering. Still further, one or more of the poles 103 and 105 and the panels 107 may be formed from separate pieces of the outer covering. The separate poles 103 and 105 and panels 107 can then be sown, adhered, or otherwise joined to each other, or sown, adhered, or otherwise joined to the underlying carcass (or bladder if a carcass is omitted). The channels 109 may then be formed by laminating, painting, or otherwise applying material to the appropriate locations, e.g., joints between the poles 103 and 105 and panels 107.

With yet other example structures according to this invention, the basketball 101 may omit the channels 109, the poles 103 and 105, or both. For example, the basketball 101 may be formed with an outer covering that omits the channels 109, so that the basketball appears to have a continuous surface over the entire circumference of the ball. The basketball 101 alternately may be formed with an outer covering that omits both the channels 109 and the poles 103 and 105, so that the basketball appears to have a continuous surface over the entire surface area of the ball. Other structural arrangements of the cover features are possible without departing from this invention.

Figure 2:
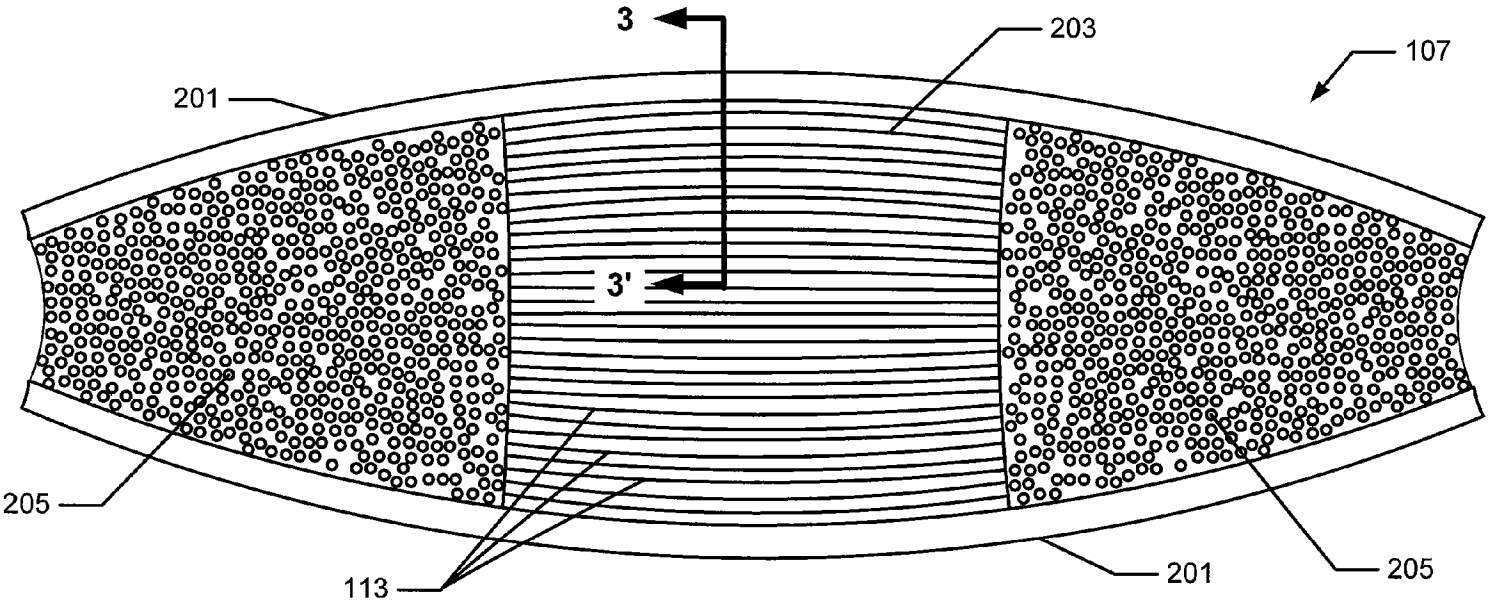
FIG. 2 is a top planar view of an example ribbed panel that may be used in ball structures according to some examples of this invention.

As further illustrated in FIG. 1A, the surface of this example basketball structure 101 according to the invention also includes a plurality of ribs 113. The ribs 113 are illustrated in more detail in FIGS. 2 and 3. FIG. 2 shows a top planar view of one panel 107, while FIG. 3 shows a cross section of the panel 107 shown in FIG. 2 (along with a portion of an adjacent panel) along section line 3-3' from FIG. 2.

Referring now to FIG. 2, the panel 107 has a channel area 201 running along each of its longitudinal sides. The corresponding channel areas 201 of adjacent panels 107 are joined to form a channel 109 (the channel areas 201 of adjacent panels may overlap and/or co-extend with one another). The panel 107 also has a surface texture modified area 203, which in this example panel structure 107 contains a plurality of ribs 113. On either side of the ribbed area 203 is a non-ribbed area 205. The non-ribbed areas 205 may have a conventional pebbled surface, as shown in FIG. 2. Alternately, the non-ribbed areas 205 may have a smooth surface, or a surface with any desired topography. With various example structures according to the invention, the panel 107 may omit one or both of the non-ribbed areas 205. For example, in some implementations of the invention, the ribs 113 (or other surface texture modifying elements) may extend along the entire length of the panel 107. In the planar view of FIG. 2, the ribs 113 appear relatively straight along the center of the panel 107 and appear to become more curved toward the edges of the panel 107. As will be appreciated by those of ordinary skill in the art, the ribs 113 may be arranged substantially parallel in the longitudinal direction when the panel is formed into the spherical shape of the ball 101.

Figure 3:
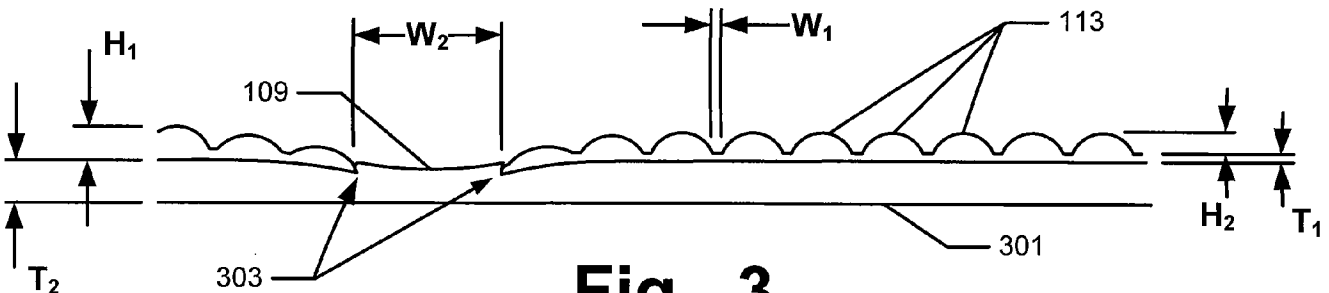
FIG. 3 is a cross section of the panel shown in FIG. 2 along section line 3-3'.

FIG. 3 illustrates the ribs 113 of this example panel structure 107 in more detail. As illustrated in this figure, the ribs 113 are formed on the outer covering 301 of the basketball 101. The ribs 113 may be formed of any desirable material such as, for example, polyurethane or rubber. In the illustrated example, the ribs 113 may be formed separately from the outer covering 301, and then laminated, adhered, or otherwise secured to the outer covering 301. With alternate examples of the invention, however, the ribs 113 may be formed integrally with the outer covering 301. For example, the outer covering 301 may be molded or pressed to have a topography forming the ribs 113.

With various example structures according to this invention, the ribs 113 may have any desired size and shape. In the illustrated example of the invention, however, the ribs 113 have an overall height (from the top of covering 301 to the rib tip, dimension "$H_1$") of approximately 1 mm, with a distance between the crest and trough of a rib (from the base surface of the cover member to the rib tip, dimension "$H_2$") being approximately 0.8 mm (which leaves the thickness (dimension "$T_1$") of the cover member base surface of approximately 0.2 mm in this example structure). The width of the trough between ribs 113 (dimension "$W_1$") in the illustrated example structure is about 0.5 mm or less, although other widths may be used without departing from this invention. The width of the channel 109 (dimension "$W_2$") in this example structure may be approximately 6 mm. The outer covering 301 or bladder thickness (or combined bladder and carcass thickness), dimension "$T_2$", in this example structure, may be about 1.9 mm.

In the illustrated example, the ribs 113 are formed so that the contour of a channel 109 generally merges into the contour of its adjacent ribs 113. More particularly, as shown at locations 303 in FIG. 3, the side of one or more ribs 113 adjacent to a channel 109 flows into the channel 109. This arrangement may be accomplished, e.g., by pressing the ribs 113 into the outer covering 301, and then forming a portion of the channel 109 over a portion of the adjacent side of each adjacent rib 113. Of course, other techniques and/or constructions can be employed to provide a smooth transition between a channel 109 and its adjacent ribs 113 without departing from this invention.

Figure 4:
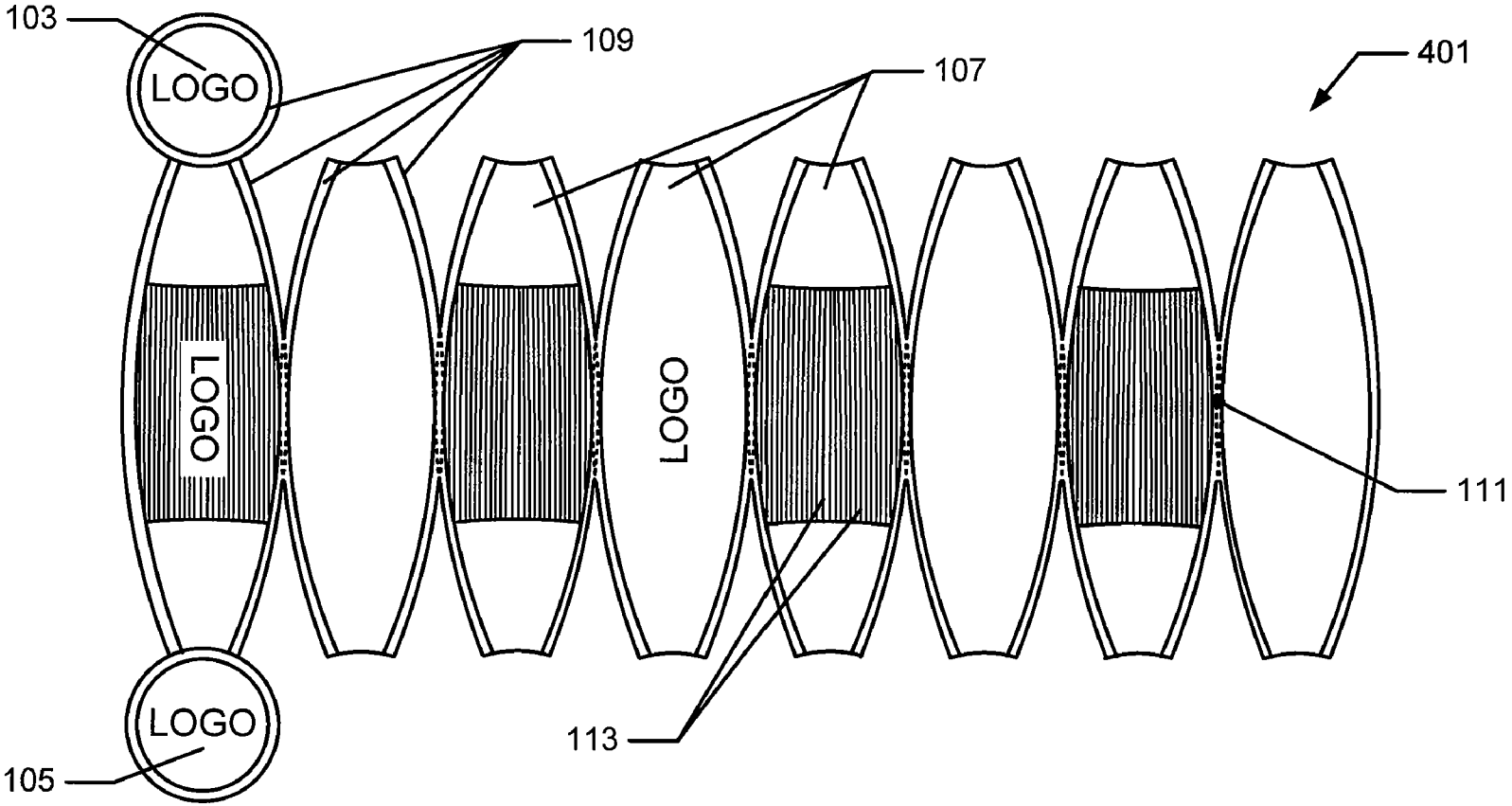
FIG. 4 illustrates another example cover member for a basketball structure according to this invention.

The exterior cover members for ball structures can take on a variety of characteristics without departing from this invention. FIG. 4 illustrates another example of an exterior cover member structure 401 according to at least some examples of this invention (the same reference numbers are used in FIG. 4 as used in other figures above when identifying the same or similar features or parts, and thus the corresponding description thereof will be omitted). As illustrated in this figure, not every panel 107 includes surface texture modifying elements, such as raised ribs 113. Rather, as illustrated in FIG. 4, every other panel 107 includes the surface texture modifying elements 113 in its central region. Of course, other arrangements of panels with and without surface texture modifying elements may be used without departing from this invention.

Figure 5:
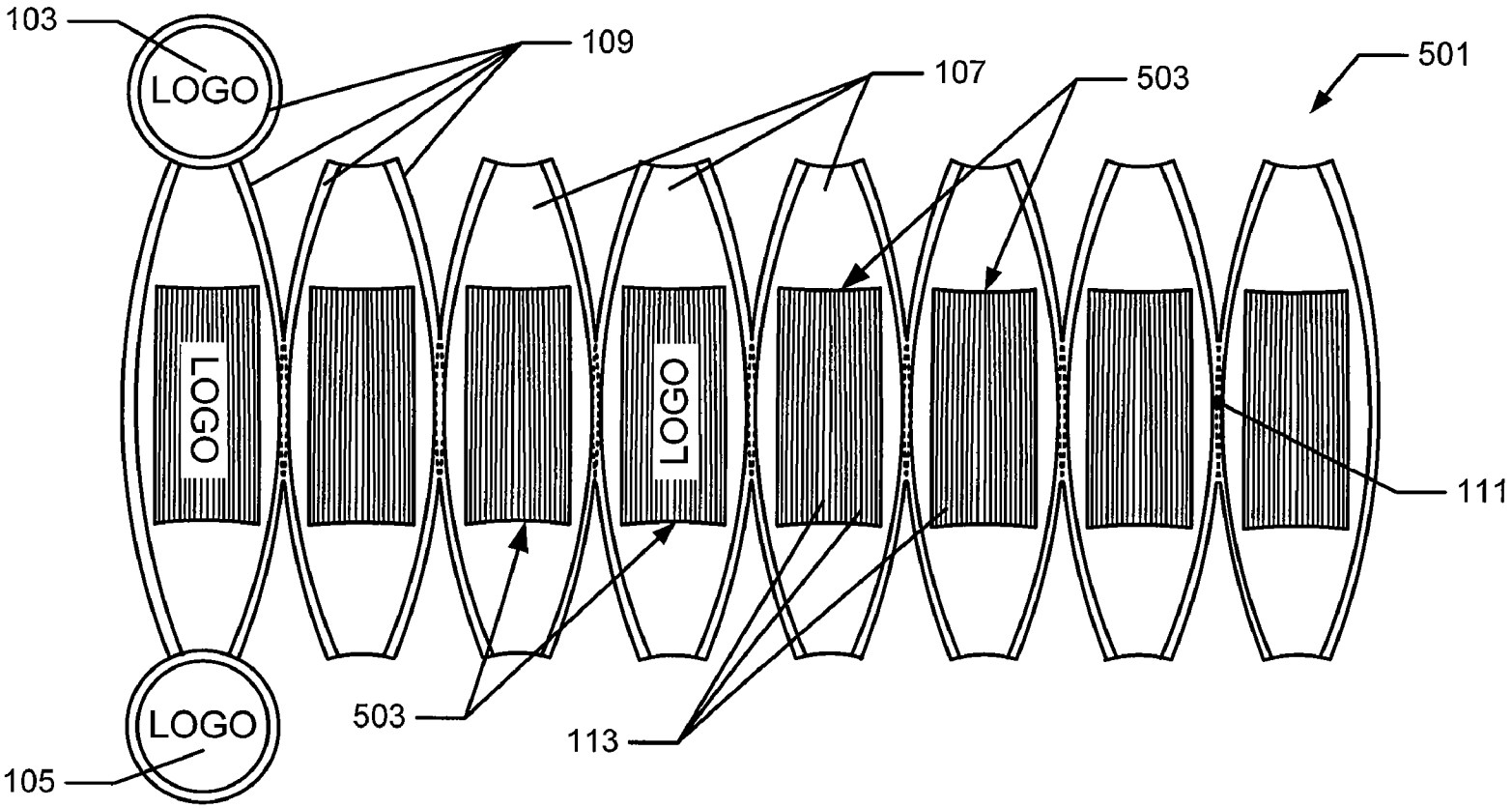
FIG. 5 illustrates another example cover member for a basketball structure according to this invention.

In the various example cover member structures according to the invention described above, when it was present, the surface texture modifying portion of a panel (e.g., the portion of a panel 107 including the ribs 113 or other surface texture modifying elements) extended continuously across the panel from one channel 109 to the opposite channel 109 (e.g., in the latitudinal direction). This is not a requirement. For example, as illustrated in FIG. 5, the portions 503 of exterior cover member 501 including the raised ribs 113 or other surface texture modifying elements need not extend completely across the panel 107 in the latitudinal direction. Rather, as shown in this figure, the surface texture modifying portions 503 of the panels 107 stop short of the channels 109. Additionally (and as also illustrated in FIGS. 1B and 4), the surface texture modifying portion(s) (e.g., portion 503) of a panel 107 may include logos, graphics, and/or other information or indicia, and this additional information also may interrupt the rib structure or other surface modifying element arrangement. In structure 501, it is not necessary to modify the ribs 113 (or other structures) located adjacent the channels to more smoothly flow into the channels 109 (as described above in conjunction with FIG. 3).

Figure 6:
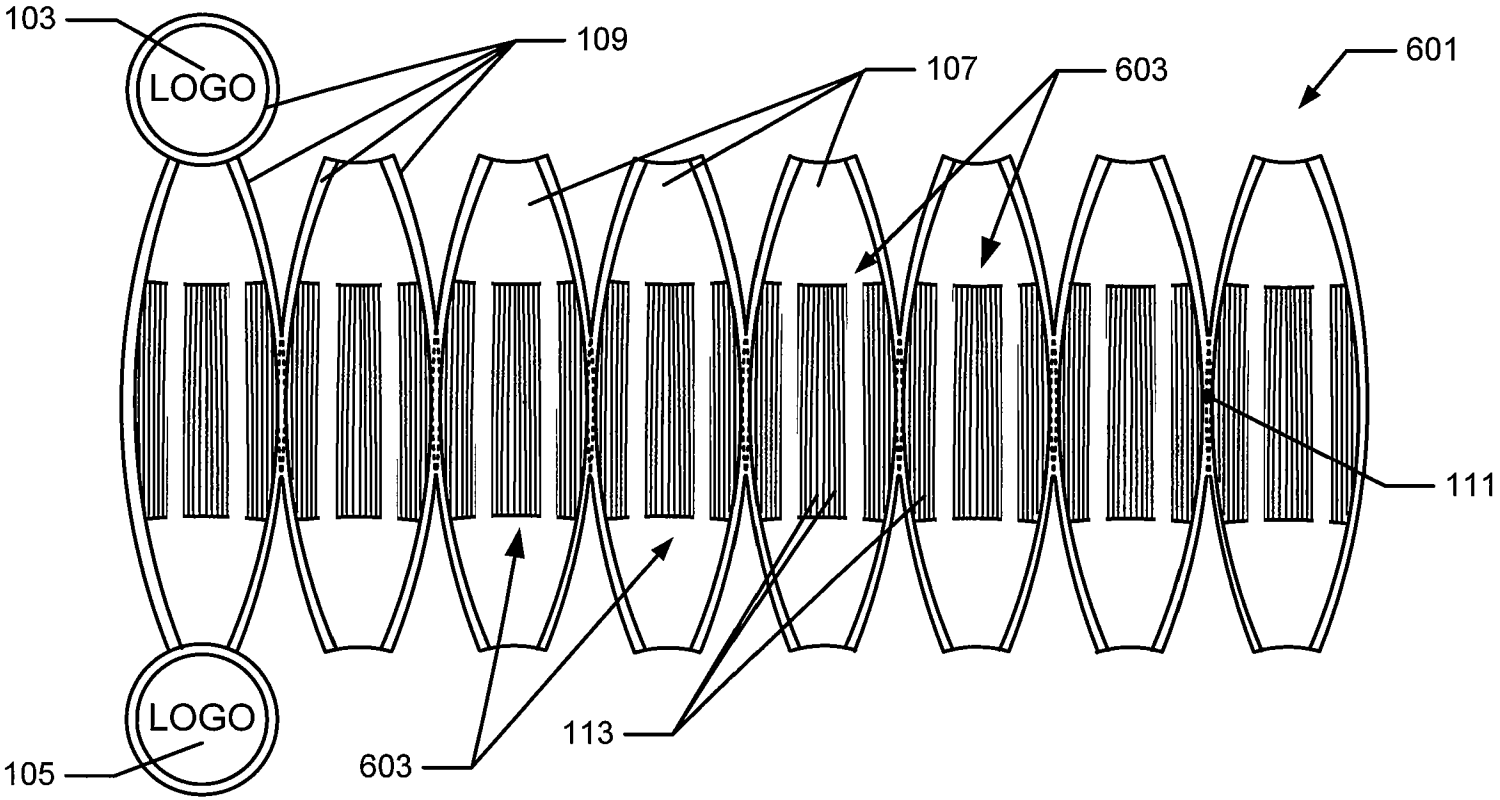
FIG. 6 illustrates yet another example cover member for a basketball structure according to this invention.

FIG. 6 illustrates another example exterior cover member structure 601 in which the surface texture modifying regions 603 do not extend continuously across the various panels 107 when viewed in the latitudinal direction. Rather, as shown in this figure, the surface texture modifying regions 603 of each panel 107 include multiple separate portions or sections (e.g., longitudinal ribbed sections separated by spaces without ribs or with different texturing). If desired, the separation spaces (or differently textured sections) may include the same texture as the areas of the panel 107 outside the surface texture modifying regions 603 (e.g., a pebbled type texture or other conventional ball surface textures). Additionally or alternatively, if desired, the separation spaces (or the differently textured sections within the surface texture modifying regions 603) need not extend the complete length and/or width of the surface texture modifying regions 603 (e.g., if desired, the separations may be completely surrounded or partially surrounded by surface texture modifying structures, such as the ribs 113 or other structures). Additionally or alternatively, if desired, one or more of the ribs 113 or other structures may include gaps or spaces in the longitudinal direction.

Any desired arrangement of textured (e.g., ribbed) sections and separation spaces (or differently textured sections) may be included in individual surface texture modifying regions 603 without departing from this invention. As another example, if desired, the textured sections 603 and their included separation spaces may be structured and arranged to produce a logo or other feature on the surface of the cover member 601. As yet another example, plural textured sections 603 over the course of multiple panels 107 may cooperate or be viewed together to produce a logo, corporate name, or other desired indicia on the surface of a ball. Each panel 107 need not have the same identical textured section 603 (and some panels 107 may have no textured section 603, if desired).

Figure 7:
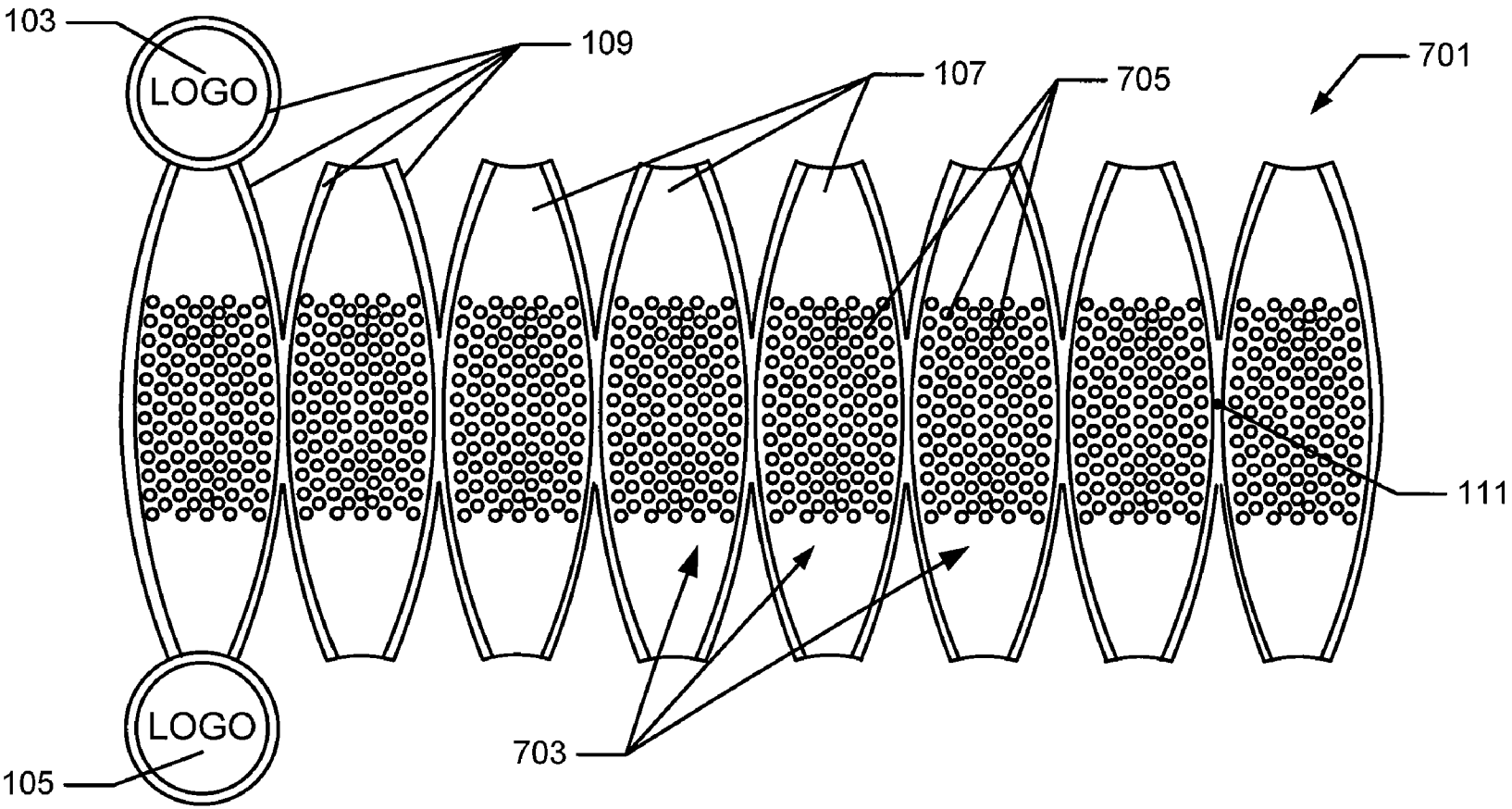
FIG. 7 illustrates still another example cover member for a basketball structure according to this invention.

In the various example ball structures described above, the texture modifying structures have been illustrated in the form of raised ribs that extend (continuously or discontinuously) in the longitudinal direction of the various panels 107. This is not a requirement. FIG. 7 illustrates an example exterior ball cover member 701 in which the surface texture modifying sections 703 are formed as individual raised surfaces or "bumps" 705. Any desired shaped raised surface or bump may be used without departing from this invention, such as hemispheres or other portions of a sphere, hemi-ellipsoids or other portions of an ellipsoid, paraboloids, polygons (such as cubic structures), cylinders, irregularly shaped extensions or protrusion, etc. In order to provide a clear feel and tactile distinction from other areas of the ball, these raised surfaces or bumps 705 should be made larger and/or higher than the relatively low and smooth features of other surfaces of the ball, such as the conventional pebbling texture on basketball (and other ball) structures. For example, if desired, the free ends of the bumps or raised surfaces may extend at least 0.5 mm above the base surface of the cover member (e.g., dimension $H_2$ in FIG. 3). While any desired raised surface height $H_2$ may be used without departing from this invention, in some example structures, this dimension may be in the range of 0.5 to 12 mm, 0.7 to 10 mm, or even 0.7 to 6 mm. Ideally, the ribs, bumps, or other surface texture modifying structures will be made sufficiently large and will be appropriately arranged so as to provide good tactile feedback to the user while not being so large and/or arranged so as to adversely effect movement of the ball, e.g., when it contacts another object, such as the floor, the backboard, the basketball rim, etc. (i.e., the ball should still produce a true "bounce" that substantially replicates the action of a conventional ball).

The individual bumps 705 may be arranged in any desired pattern without departing from this invention, including in regular patterns, staggered patterns, random patterns, continuous patterns, discontinuous patterns, and the like. Additionally, if desired, as described above, the bumps 705 may be arranged to produce logos, pictures, words, or any other desired indicia on the surface of the ball. Moreover, each panel 107 of a given ball structure need not have the same arrangement of bumps 705 (or other surface texture modifying structures). In fact, if desired (and as described above in conjunction with FIG. 4), some panels 107 may include no bumps 705 or other surface texture modifying structures.

If desired, ball structures in accordance with at least some examples of this invention may include additional structures or features that help provide a distinct tactile or "feel" characteristic for certain areas of the ball surface with respect to the others. For example, if desired, the material of the surface texture modifying region may have a somewhat different hardness as compared with the material outside of this region (e.g., the conventional basketball cover material). As another example, if desired, the material of the surface texture modifying region may have a somewhat different thermal conductivity as compared with the material outside of this region (so that it may feel a slightly different temperature). As yet another example, if desired, the material of the surface texture modifying region may be heated or cooled while the material outside this region is not temperature modified (or vice versa).

Other features may be included in ball structures according to at least some examples of this invention. For example, as noted above, features may be provided to enhance visualization of the alignment, spin, or rotation of the ball as it is thrown, shot, or otherwise moved. One way of doing this would be to make the color of the material of the surface texture modifying region (or portions thereof) different from the color of the material outside this region. On the other hand, modification of the colors may not be necessary, e.g., if such modification is not desired and/or if the structure of the surface texture modifying adequately stand out visually.

C. Conclusion

While the invention has been described with respect to specific examples including presently preferred modes of carrying out the invention, those skilled in the art will appreciate that there are numerous variations and permutations of the above described example structures that fall within the spirit and scope of the invention as set forth in the appended claims.

I claim:

1. A basketball, comprising:

a ball structure including a cover member that defines or covers a gas-tight chamber, wherein the cover member includes an exterior surface divided into a plurality of panels separated by channels, the plurality of panels including a first panel having a first channel at a first edge thereof and a second channel at a second edge thereof, wherein an exterior surface of the first panel includes a first region, housed completely between the first and second channel, having a first surface texture and a second region having a second surface texture that is different from the first surface texture, wherein the first region extends at least over a central portion of the first panel, and wherein the first surface texture is provided, at least in part, by plural ribs that extend in a direction along the first channel and by plural ribs that extend in a direction along the second channel.

2. A basketball according to claim 1, wherein the exterior surface of the first panel includes a third region separate from the second region that also has the second surface texture.

3. A basketball according to claim 2, wherein the second region extends between the first channel and the second channel and is located on a first side of the first region and the third region extends between the first channel and the second channel and is located on a second side of the first region opposite from the first side.

4. A basketball according to claim 2, wherein the first region extends continuously between the first and second channels.

5. A basketball according to claim 4, wherein the second region extends continuously between the first and second channels and the third region extends continuously between the first and second channels.

6. A basketball according to claim 1, wherein the plurality of panels includes at least eight panels.

7. A basketball according to claim 6, wherein each panel includes a central portion having the first surface texture.

8. A basketball according to claim 7, wherein the central portions including the first surface texture align.

9. A basketball according to claim 6, wherein at least one panel does not include the first surface texture.

10. A basketball according to claim 1, wherein a first end of the first panel includes a first pole region.

11. A basketball according to claim 10, wherein a second end of the first panel opposite the first end includes a second pole region.

12. A basketball according to claim 1, wherein a rib located immediately adjacent the first channel is shaped and arranged to slope toward the first channel.

13. A basketball according to claim 12, wherein a rib located immediately adjacent the second channel is shaped and arranged to slope toward the second channel.

14. A basketball according to claim 12, wherein a base surface of the first channel is contoured.

15. A basketball according to claim 14, wherein the base surface of the first channel is contoured in a direction away from the plural ribs.

16. A basketball according to claim 1, wherein the plurality of panels further includes a second panel having a first channel at a first edge thereof and a second channel at a second edge thereof, wherein the first channel of the second panel is at least partially co-extensive with the second channel of the first panel.

17. A basketball according to claim 16, wherein an exterior surface of the second panel includes the first surface texture, wherein the first region of the second panel extends at least over a central portion of the second panel, and wherein the first surface texture of the second panel is provided, at least in part, by plural ribs that extend in a direction along the first channel of the second panel and by plural ribs that extend in a direction along the second channel of the second panel.

18. A basketball according to claim 17, wherein the exterior surface of the second panel includes a second region having the second surface texture.

19. A basketball according to claim 17, wherein the exterior surface of the first panel includes a third region separate from the second region that also has the second surface texture, wherein the second surface texture is different from the first surface texture, and wherein the exterior surface of the second panel includes a second region having the second surface texture and a third region separate from the second region that also has the second surface texture.

20. A basketball according to claim 17, wherein the first regions of the first and second panels each extends continuously between their panel's respective first and second channels.

21. A basketball according to claim 1, wherein the second surface texture is a pebbled texture.

22. A basketball according to claim 21, wherein the second region surrounds the first region.

23. A basketball according to claim 1, further comprising:

a gas-tight bladder that defines the gas-tight chamber, wherein the cover member encloses the gas-tight bladder.

24. A basketball according to claim 23, further comprising:

a valve member that allows inflation of the gas-tight chamber.

25. A basketball, comprising:

a ball structure including a cover member that defines or covers a gas-tight chamber, wherein the cover member includes an exterior surface divided into a plurality of panels separated by channels, the plurality of panels including a first panel having a first channel at a first edge thereof and a second channel at a second edge thereof, wherein an exterior surface of the first panel includes a first region, housed completely between the first and second channel, having a first surface texture and a second region having a second surface texture, wherein the first region extends at least over a central portion of the first panel, and wherein the first surface texture is provided, at least in part, by plural raised elements extending at least 0.5 mm outward from a base surface of the cover member.

26. A basketball, comprising:

a ball structure including a cover member that defines or covers a gas-tight chamber, wherein the cover member includes an exterior surface divided into a plurality of panels separated by channels, the plurality of panels including a first panel having a first channel at a first edge thereof and a second channel at a second edge thereof, wherein an exterior surface of the first panel includes a first region having a first surface texture and a second region having a second surface texture that is different from the first surface texture, wherein the first region extends at least over a central portion of the first panel, and wherein the first surface texture is provided, at least in part, by plural ribs that extend in a direction along at least one of the first channel and second channel.

* * * * *